US009245422B2

(12) United States Patent
Singer et al.

(10) Patent No.: US 9,245,422 B2
(45) Date of Patent: Jan. 26, 2016

(54) METHOD OF SIMULTANEOUS INDICATION OF MULTIPLE WINNING COMBINATIONS IN A SYMBOL MATRIX

(71) Applicant: IGT, Las Vegas, NV (US)

(72) Inventors: Anthony M. Singer, Saddle River, NJ (US); T. Grant Bolling, Jr., Maryland Heights, MO (US); Daniel M. Marks, Decatur, GA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 14/505,803

(22) Filed: Oct. 3, 2014

(65) Prior Publication Data

US 2015/0031438 A1 Jan. 29, 2015

Related U.S. Application Data

(63) Continuation of application No. 12/454,191, filed on May 13, 2009, now Pat. No. 8,851,970.

(60) Provisional application No. 61/127,556, filed on May 14, 2008.

(51) Int. Cl.
*G07F 17/34* (2006.01)
*G07F 17/32* (2006.01)

(52) U.S. Cl.
CPC ..... *G07F 17/34* (2013.01); *G07F 17/32* (2013.01); *G07F 17/3213* (2013.01); *G07F 17/3227* (2013.01)

(58) Field of Classification Search
CPC ..... G07F 17/34; G07F 17/3217; G07F 17/32
See application file for complete search history.

(56) References Cited

U.S. PATENT DOCUMENTS

| | | | | |
|---|---|---|---|---|
| 5,580,053 | A | 12/1996 | Crouch | |
| 6,004,208 | A | 12/1999 | Takemoto et al. | |
| 6,695,696 | B1 | 2/2004 | Kaminkow | |
| 6,890,254 | B2 | 5/2005 | Kaminkow | |
| 6,960,133 | B1 | 11/2005 | Marks et al. | |
| 7,137,886 | B2 | 11/2006 | Locke et al. | |
| 7,257,716 | B2 | 8/2007 | Gaya | |
| 7,481,710 | B2 | 1/2009 | Kaminkow | |
| 2005/0187011 | A1 | 8/2005 | Kaminkow | |
| 2005/0239533 | A1* | 10/2005 | Inamura | 463/16 |
| 2006/0281525 | A1 | 12/2006 | Borissov | |
| 2008/0045300 | A1* | 2/2008 | Quayle et al. | 463/18 |
| 2008/0182645 | A1 | 7/2008 | Okada | |
| 2008/0248863 | A1* | 10/2008 | Seymour et al. | 463/21 |
| 2008/0274789 | A1 | 11/2008 | Singer et al. | |
| 2009/0042637 | A1 | 2/2009 | Singer et al. | |
| 2009/0286591 | A1 | 11/2009 | Singer et al. | |

OTHER PUBLICATIONS

Phantom EFX, Reel Deal Slots Adventure, 2007, Phantom EFX, PC DDV (6 pages).

* cited by examiner

*Primary Examiner* — William Coleman
(74) *Attorney, Agent, or Firm* — Neal, Gerber & Eisenberg LLP

(57) ABSTRACT

The present invention teaches novel methods for simultaneous indication of winning combinations in the symbol matrix. More specifically, the present invention simultaneously indicates all winning combinations formed by symbols appearing in symbol positions common to multiple pay lines. In a preferred embodiment, symbol positions common to multiple pay lines that display winning symbol combinations are simultaneously indicated to the player in a first manner. In addition, the remaining symbol positions for each of said multiple pay lines are simultaneously indicated in a second manner.

22 Claims, 6 Drawing Sheets

METHOD OF SIMULTANEOUS INDICATION OF MULTIPLE WINNING COMBINATIONS IN A SYMBOL MATRIX

PRIORITY CLAIM

This application is a continuation of, and claims priority to and the benefit of, U.S. patent application Ser. No. 12/454,191, filed on May 13, 2009, which claims priority to and the benefit of U.S. Provisional Patent Application Ser. No. 61/127,556, filed on May 14, 2008, the entire contends of each of which are incorporated herein by reference.

COPYRIGHT NOTICE

A portion of the disclosure of this patent document contains or may contain material subject to copyright protection. The copyright owner has no objection to the photocopy reproduction of the patent document or the patent disclosure in exactly the form it appears in the Patent and Trademark Office patent file or records, but otherwise reserves all copyright rights.

FIELD OF INVENTION

In general, the present invention relates to methods of simultaneous indication of multiple winning combinations in a symbol matrix of a slot machine game.

BACKGROUND OF THE INVENTION

To play a conventional slot machine, the player deposits money into the machine, sets the wager, and spins the reels. When the reels stop spinning, the player collects credits for winning symbol combinations displayed on the plurality of pay lines defined across the reels. All wins, if any, are then paid in accordance with a predetermined pay schedule.

While the appearance of conventional slot machines may change from one theme, such as space aliens, to another theme, such as farm animals, the underlying methods of play—setting the wager, spinning the reels, collecting awards—remain the same from machine to machine.

One element of conventional slot machines that has been changing, however, is the number of pay lines defined across the reels, with each new generation of games offering an ever increasing number of pay lines.

As the number of pay lines grows from 40 to 50 to 100 or more, the number of possible winning symbol combinations also increases. Since conventional slot machines indicate each winning symbol combination to the player one-at-a-time, it takes more and more time for the gaming device to cycle through each of the winning symbol combinations.

The time required to indicate individual winning symbol combinations causes the player to suffer from delay and boredom; deprives the gaming operators of valuable playing time and revenue; and discourages manufacturers from creating and offering additional gaming products with high pay line counts.

Thus, new methods of indicating winning symbol combinations in slot machine games are required to enhance the value of these games to players, casinos, and manufacturers.

SUMMARY OF THE INVENTION

The present invention teaches novel methods for simultaneous indication of winning combinations in the symbol matrix. More specifically, the present invention simultaneously indicates all winning combinations formed by symbols appearing in symbol positions common to multiple pay lines.

In a preferred embodiment, a plurality of pay lines are defined across a 3-row by 5-column symbol matrix with each pay line comprised of one symbol position from each column. Every pay line uses a unique combination of 5 symbol positions such that any two pay lines may only share up to 4 common symbol positions.

Any symbol positions common to multiple pay lines that display winning symbol combinations are simultaneously indicated to the player in a first manner. In addition, the remaining symbol positions for each of said multiple pay lines are simultaneously indicated in a second manner.

For example, a winning combination of symbols (i.e. A-A-A) appears in three symbol positions common to five pay lines. The three symbol positions displaying a winning symbol (i.e. "A") are simultaneously indicated by a colored box; the remaining two symbol positions for each of the five pay lines are simultaneously indicated by a colored line.

DESCRIPTION OF A PREFERRED EMBODIMENT

Figure 1:
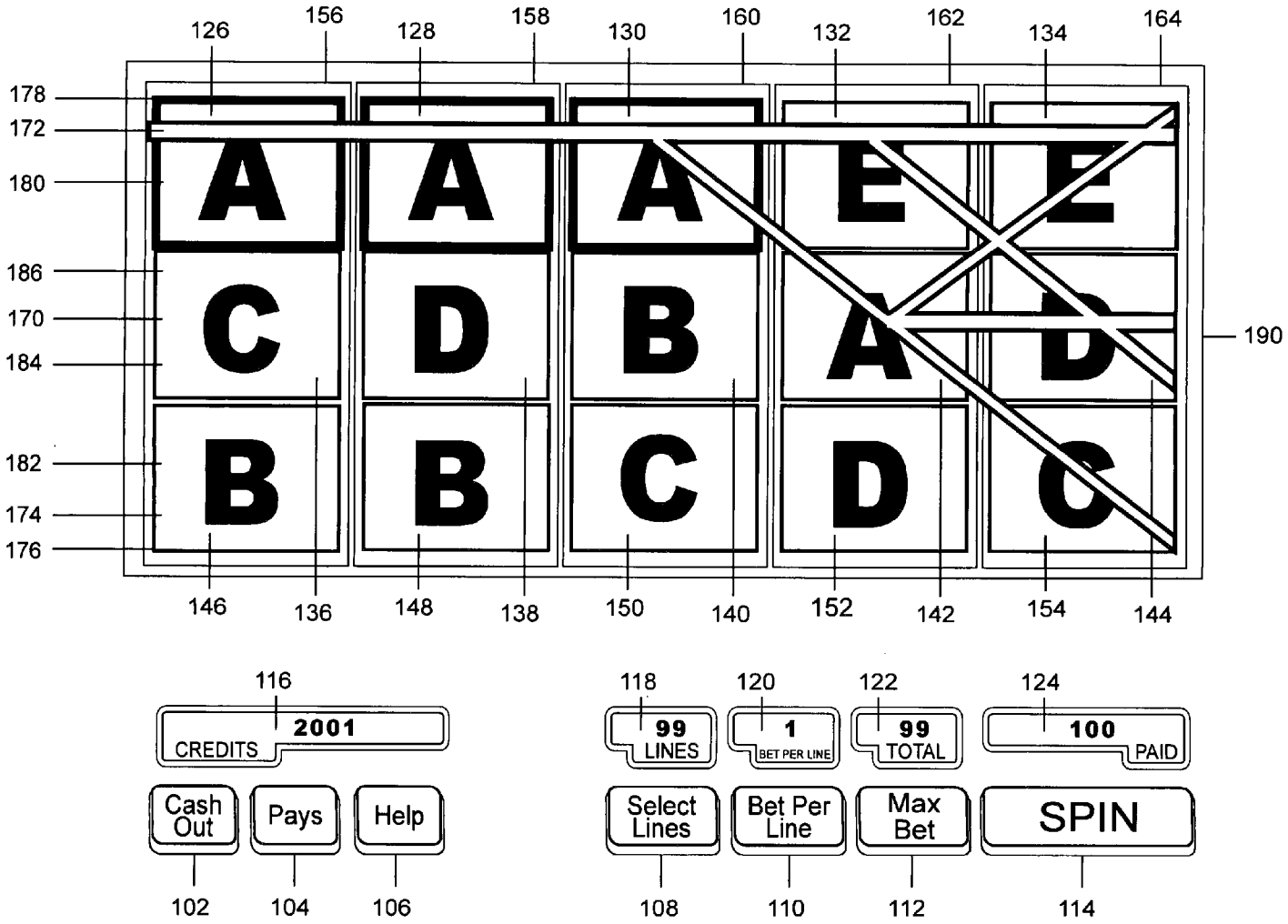
FIG. 1 shows the simultaneous indication of winning combinations formed by symbols appearing in three symbol positions common to multiple pay lines.
Figure 2:
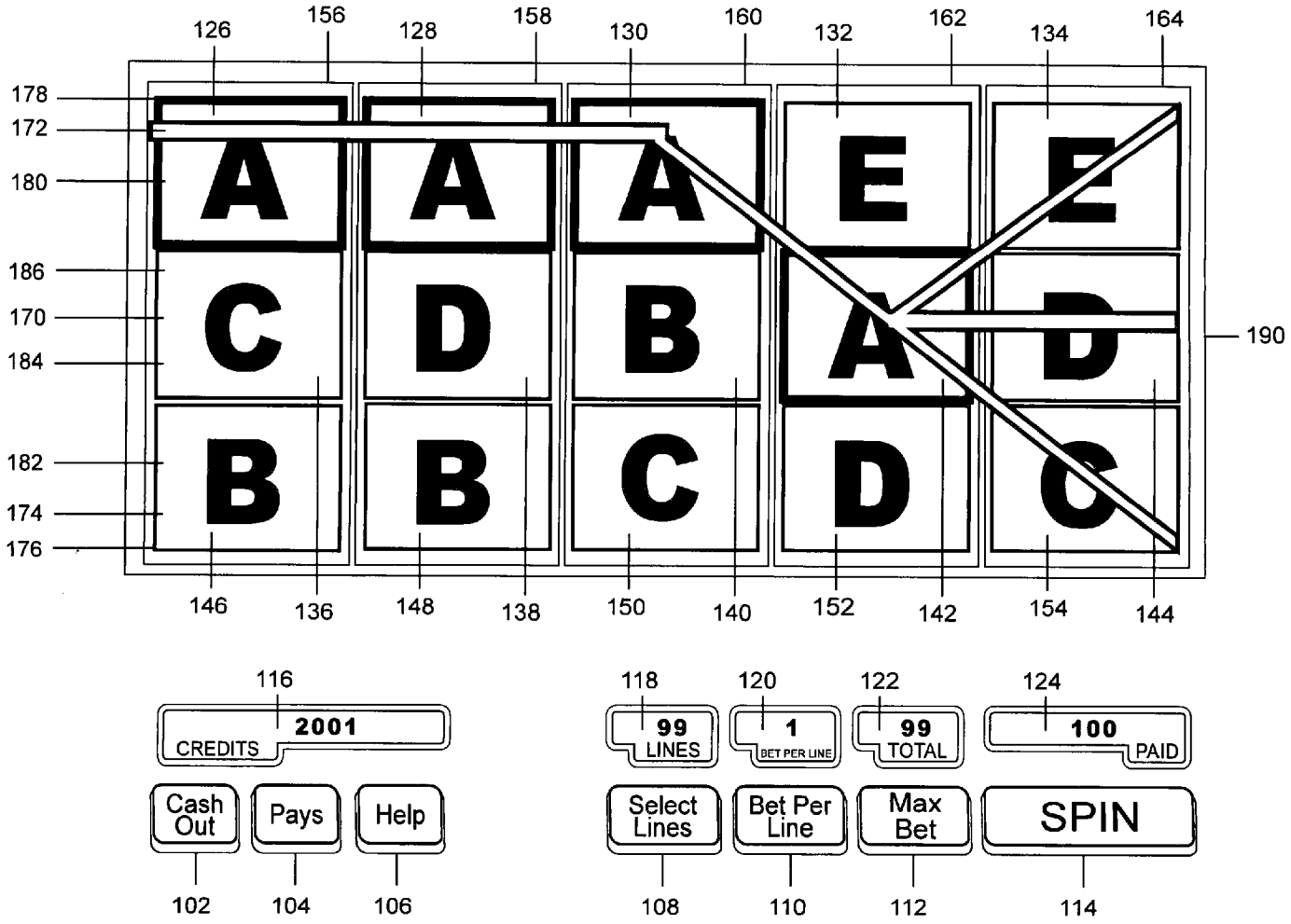
FIG. 2 shows the simultaneous indication of winning combinations formed by symbols appearing in four symbol positions common to multiple pay lines.

To play a preferred embodiment of the present invention, the player initializes credits, selects a number of pay lines, sets a wager per pay line, spins the reels, views the simultaneously indicated winning symbol combinations, and then collects awards for said winning symbol combinations, as detailed below with reference to FIGS. 1 to 6 (collectively "Figures"):

Initialize Credits. In FIGS. 1 and 2, the player initializes credits by depositing money in the form of coins, gaming tokens or paper currency into a coin head (not shown) or bill acceptor (not shown). Coins and gaming tokens are collected in a reservoir (not shown) inside the gaming machine; paper currency is collected in the bill acceptor (not shown) inside the gaming machine.

If the coins, gaming tokens or paper currency are validated as authentic, the player accrues the appropriate number of playing credits on the Credit meter 116. More credits may be initialized, if necessary, by additional deposits. Alternatively, any method of initializing credits may be used including debit cards, credit cards, or other form of electronic funds transfer.

Select the Number of Pay Lines. In FIGS. 1 and 2, the player selects the number of pay lines upon which to wager. The player may select from 1 to 99 pay lines defined across the 3-row by 5-column symbol matrix 190. To select pay lines, the player uses the Select Pay Lines button 108 and views the number of selected pay lines on the Select Pay Lines meter 118.

Figure 3:
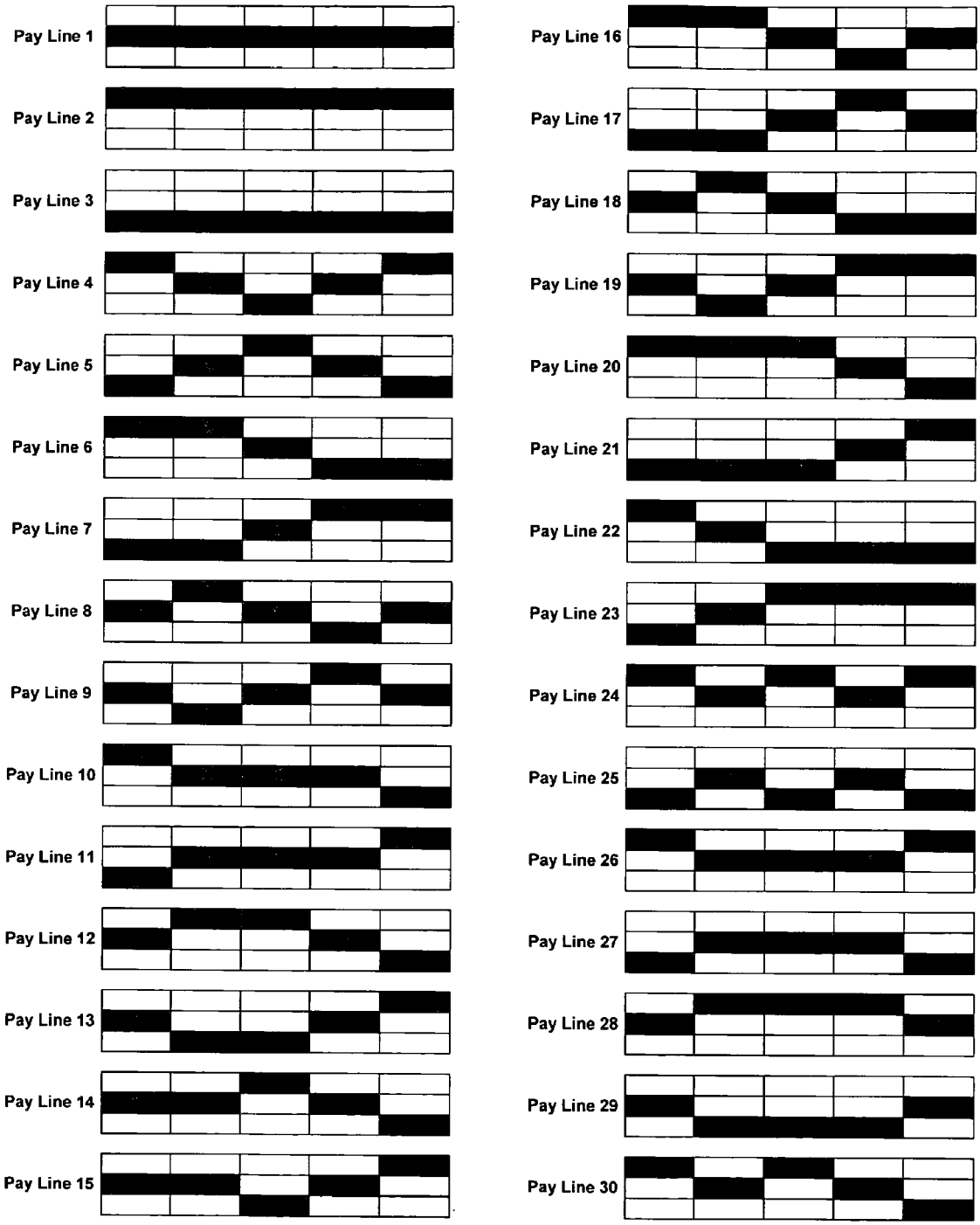
FIG. 3 shows the paths defined across the symbol matrix for pay lines numbered 1-30.
Figure 4:
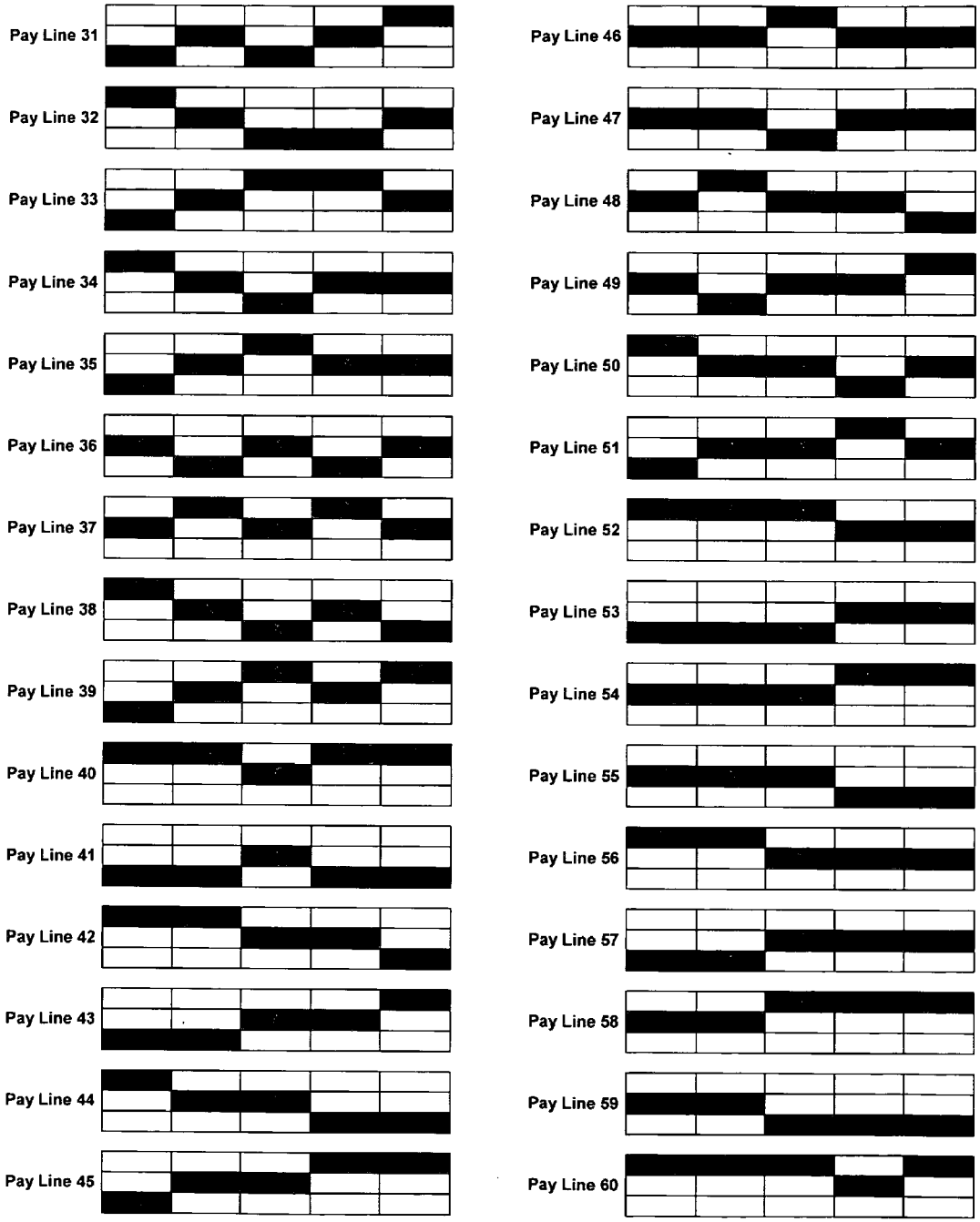
FIG. 4 shows the paths defined across the symbol matrix for pay lines numbered 31-60.
Figure 5:
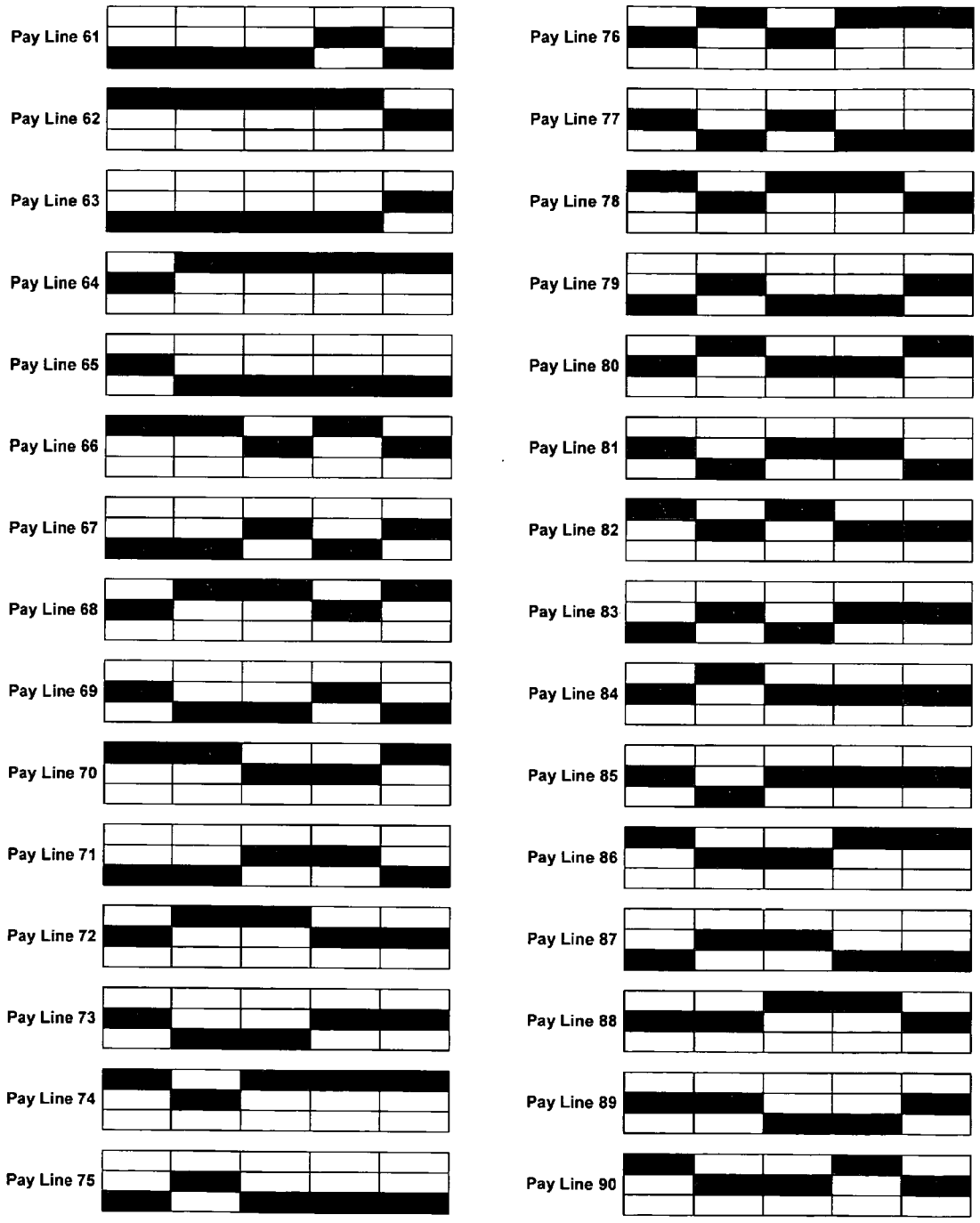
FIG. 5 shows the paths defined across the symbol matrix for pay lines numbered 61-90.
Figure 6:
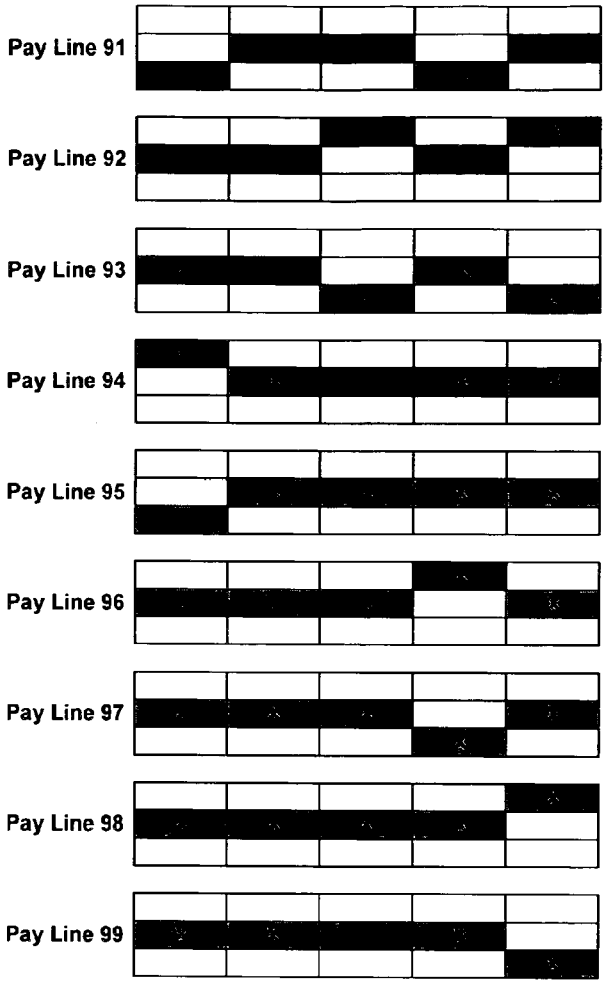
FIG. 6 shows the paths defined across the symbol matrix for pay lines numbered 91-99.

The pay lines must be selected in accordance with a predetermined order (i.e. pay line 1 is selected first, pay line 2 is selected second, and pay line N in selected Nth). FIGS. 3 to 6 illustrate the specific predetermined order of the pay lines and the defined path of each said pay line: FIG. 3 illustrates pay lines 1 to 30; FIG. 4 illustrates pay lines 31 to 60; FIG. 5 illustrates pay lines 61 to 90; and FIG. 6 illustrates pay lines 91 to 99.

Setting the Wager Per Pay Line. In FIGS. 1 and 2, the player sets the bet per pay line. The player may wager from 1 to M credits per selected pay line. To set the bet per pay line, the player uses the Bet Per Pay Line button 110 and views the amount bet per pay line on the Bet Per Pay Line meter 120. The same amount is wagered on each pay line. For example, five credits may be wagered on each pay line. Alternatively, the player may wager a credit upon a group of two or more pay lines, with a fraction of the credit allocated to each of the selected pay lines.

The total wager is then calculated by multiplying the number of selected pay lines by the bet per pay line. For example, the player wagers five credits on each of ninety-nine pay lines for a total bet of four hundred ninety-five credits. The total bet amount is displayed on the Total Bet meter 122.

In addition to using the Select Pay Lines button 108 and Bet Per Pay Line button 110, the player may also use the Bet Max button 112 to place the maximum bet per pay line on all of the pay lines. Alternatively, any wager may be assigned a button.

Spin the Reels. In FIGS. 1 and 2, the player uses the Spin button 114 to randomly rearrange the symbols displayed in the symbol matrix 190. The symbol matrix 190 contains three symbol positions for each of the five slot reels 156-164 for a total of fifteen symbol positions 126-154. Alternatively, any number of reels with any number of symbol positions may be used.

The slot reels 156-164 spin and randomly stop one reel at-a-time, from left to right, until all five reels have stopped and all fifteen symbol positions 126-154 of the symbol matrix 190 are revealed. Alternatively, any size symbol matrix may be used and any method may be used to rearrange symbols in the symbol matrix.

Indication of Winning Symbol Combinations. The player views all winning symbol combinations appearing on selected pay lines, including simultaneous indication of multiple winning combinations formed by symbols appearing in symbol positions common to multiple selected pay lines.

Winning symbol combinations may be formed by two or more, same, adjacent symbols, starting from the leftmost position of a pay line. For example, four adjacent "A" symbols (i.e. A-A-A-A) appearing in the leftmost positions of a selected pay line form a winning symbol combination.

Winning symbol combinations may also be formed using wildcard symbols. For example, three adjacent "A" symbols and an adjacent wildcard symbol ("W") acting as an "A" symbol (i.e. A-A-A-W) appearing in the leftmost positions of a selected pay line form a winning symbol combination.

If a winning symbol combination appears in symbol positions common to multiple selected pay lines, each of those common positions displaying a winning symbol are simultaneously indicated to the player in a first manner and each of the symbol positions on these pay lines not displaying a winning symbol are simultaneously indicated in a second manner. Thus, the game simultaneously indicates all of the selected pay lines with winning symbol combinations formed by symbol positions common to said pay lines.

In FIGS. 1 and 2, four adjacent "A" symbols (i.e. A-A-A-A) appear in the symbol matrix: the first "A" symbol appears in the top position 126 of the first column 156, the second "A" symbol appears in the top position 128 of the second column 158, the third "A" symbol appears in the top position 130 of the third column 160, and the fourth "A" symbol appears in the middle position 142 of the fourth column 162.

FIG. 1 shows the simultaneous indication of "A" symbols appearing in three symbol positions common to five pay lines: 2, 20, 52, 60, and 62. The three common symbol positions displaying said "A" symbols are indicated with thickened boxes around the top position 126 of the first column 156, the top position 128 of the second column 158, and the top position 130 of the third column 160. The remaining two symbol positions for each of the five pay lines are indicated with a line connecting said common symbol positions with said remaining positions, as follows:

- Pay line 2 (as defined on FIG. 3) is indicated by connecting said common positions with remaining positions at the top position 132 of fourth column 162 and top position 134 of fifth column 164;
- Pay line 20 (as defined on FIG. 3) is indicated by connecting said common positions with remaining positions at middle position 142 of fourth column 162 and bottom position 154 of fifth column 164;
- Pay line 52 (as defined on FIG. 4) is indicated by connecting said common positions with remaining positions at middle position 142 of fourth column 162 and middle position 144 of fifth column 164;
- Pay line 60 (as defined on FIG. 4) is indicated by connecting said common positions with remaining positions at middle position 142 of fourth column 162 and top position 134 of fifth column 164; and
- Pay line 62 (as defined on FIG. 5) is indicated by connecting said common positions with remaining positions at top position 132 of fourth column 162 and middle position 144 of fifth column 164.

FIG. 2 shows the simultaneous indication of "A" symbols appearing in four symbol positions common to three pay lines: 20, 52, and 60. The four common symbol positions displaying said "A" symbols are indicated with thickened boxes around the top position 126 of the first column 156, the top position 128 of the second column 158, the top position 130 of the third column 160, and the top position 132 of the fourth column 162. The remaining symbol position for each of the three pay lines are indicated with a line connecting said common symbol positions with said remaining position, as follows:

- Pay line 20 (as defined on FIG. 3) is indicated by connecting said common positions with the remaining position at the bottom position 154 of fifth column 164;
- Pay line 52 (as defined on FIG. 4) is indicated by connecting said common positions with the remaining position at the middle position 144 of fifth column 164; and
- Pay line 60 (as defined on FIG. 5) is indicated by connecting said common positions with the remaining position at the top position 134 of fifth column 164.

The combination of boxes and lines shown in FIGS. 1 and 2, therefore, simultaneously indicate all of the selected pay lines with winning "A" symbol combinations formed by symbol positions common to the group of pay lines with 3 common symbol positions and then simultaneously indicate the group of pay lines with 4 common symbol positions. The game alternates between indicating the winning combinations formed by 3 common symbol positions and the winning combinations formed by 4 common symbol positions.

Awards for Winning Symbol Combinations. Following indication of winning symbol combinations, the player receives awards for said winning symbol combinations. For example, a winning symbol combination using three "A" symbols (i.e. A-A-A) awards of 10× the bet per line and a winning symbol combination using four "A" symbols (i.e. A-A-A-A) awards of 25× the bet per line.

The player may also receive awards for winning symbol combinations that use wildcard symbols. For example, three "A" symbols and a wildcard symbol ("W") acting as an "A" symbol (i.e. A-A-A-W) appearing on a selected pay line is a winning symbol combination with an award of 25× the bet per line. The use of a wildcard symbol to form a winning symbol combination does not necessarily affect the award value. For example, the winning combinations A-A-A-A and A-A-A-W may both award the same 25× the bet per line award. Alternatively, wildcard symbols and/or expanded wildcard symbols may affect the award value of winning combinations.

All winning symbol combinations, including combinations with and without wildcard symbols, are listed on a predetermined pay schedule (not shown) along with their award values. The player may view the pay schedule (not shown) by pressing the Pays button 104. In addition, the player may press the Help button 106 to view the rules of the game (not shown).

If a winning symbol combination appears in symbol positions common to multiple selected pay lines, the game issues the cumulative award for all of the selected pay lines. In FIG. 1, the game issues a cumulative award of 50 for the winning combination of three "A" symbols worth 10 credits appearing on 5 selected pay lines. In FIG. 2, the game issues a cumulative award of 75 for the winning combination of four "A" symbols worth 25 credits appearing on 3 selected pay lines. In addition to each award, the game may display an award message, such as "Win 10 credits times 5 pay lines" or "Win 25 credits times 3 pay lines", detailing the award amount collected simultaneously on multiple pay lines.

Upon issuance of the award, the credits are added to the player's balance of credits, as shown on the Credit meter 116. As long as the player has credits remaining on the Credit meter 116, the player may continue to play the gaming machine. The player may also collect the balance of credits by pressing the Cash Out button 102.

Description of Alternative Embodiments

In addition to the preferred embodiment, the present invention may be modified in one or more aspects, including but not limited to the following alternative embodiments:

In an alternative embodiment, any number of pay lines may be defined across the symbol matrix of any size. For example, 100 pay lines may be defined across a symbol matrix comprised of 20 symbol positions.

In another alternative embodiment, pay lines may be defined in any manner in the symbol matrix with any number of symbol positions in any relation to each other. For example, pay lines may be defined using two or more positions from each column of the symbol matrix.

In another alternative embodiment, winning combinations may be defined in any manner. For example, winning symbol combinations may be formed by symbols appearing in non-adjacent positions of a pay line (i.e. A-x-A-A).

In another alternative embodiment, winning combinations may pay any amount on any pay line. For example, a winning combination (i.e. A-A-A) may pay 10 credits on a first pay line and 50 credits on a second pay line.

In another alternative embodiment, any number of winning combinations may be simultaneously indicated. For example, only one group of winning combinations formed by common symbol positions may be indicated at a time (i.e. A-A-A then B-B-B).

In another alternative embodiment, winning combinations may be simultaneously indicated for any length of time. For example, each group of winning combinations formed by common symbol positions may be indicated for one second (i.e. A-A-A for 1 second then B-B-B for 1 second).

In another alternative embodiment, winning combinations may be simultaneously indicated in any manner or number of manners. For example, a group of winning combinations formed by common symbol positions may be indicated by blinking the symbols appearing in those particular positions (i.e. blinking the positions displaying A-A-A).

In another alternative embodiment, winning combinations may be simultaneously indicated in any order. For example, a group of winning combinations formed by common symbol positions that generate the most valuable award may be indicated first (i.e. indicating A-A-A which awards 50 credits then indicating B-B-B which awards 25 credits).

In another alternative embodiment, the present invention may be an optional feature. For example, the player may enable or disable the simultaneous win display feature of the game by pressing a button on the gaming machine or game display screen.

In another alternative embodiment, the present invention may only be active during a portion of the game. For example, the game may only utilize a simultaneous win display feature during a bonus round of the game.

Scope & Spirit of the Present Invention

The many feature's and advantages of the present invention are apparent from the descriptions of the preferred and alternative embodiments. The present invention, however, is not limited to these particular embodiments, as the invention is capable of being practiced and carried out in various ways. For example, new features may be added to an existing embodiment or features from two or more embodiments may be combined to produce a new embodiment. Further, features mentioned in any embodiment may be interchanged with similar features not mentioned that perform the same or similar functions. And, finally, the phraseology and terminology used to explain the embodiments are only descriptive and should not be regarded as limiting. The claims, therefore, seek to cover all features and advantages that fall within the true spirit and scope of the present invention.

The invention is claimed as follows:

1. A gaming system comprising:

a display device;

an input device;

a processor; and a memory device that stores a plurality of instructions that, when executed by the processor, cause the processor to operate with the display device and the input device to:

(a) display a plurality of symbol display areas;

(b) display a plurality of paylines, each payline being associated with a different plurality of the symbol display areas, the plurality of paylines including:

(i) a first payline associated with a first plurality of the symbol display areas, and (ii) a second payline associated with a second plurality of the symbol display areas, wherein the first plurality of the symbol display areas and the second plurality of the symbol display areas are different and are associated with one or more of the same symbol display areas;

(c) randomly generate and display a plurality of symbols at the plurality of symbol display areas;

(d) for each payline:

(i) determine whether the symbols displayed at the symbol display areas associated with said payline form a first designated symbol combination; and (ii) if the symbols displayed at the symbol display areas associated with said payline form the first designated symbol combination, determine an award associated with the first designated symbol combination;

(e) if the symbols displayed at the one or more same symbol display areas associated with both the first payline and the second payline form the first designated symbol combination, simultaneously indicate the first designated symbol combination formed along both the first and second paylines by displaying a first visual indicator in association with the one or more same symbol display areas shared by both the first payline and the second payline, the first visual indicator being in addition to any displayed indications of the first and second paylines; and (f) display any determined awards.

2. The gaming system of claim 1, wherein the plurality of instructions, when executed by the processor, cause the processor to operate with the display device to display the first visual indicator by displaying an outline surrounding the one or more same symbol display areas.

3. The gaming system of claim 1, wherein the plurality of instructions, when executed by the processor, cause the processor to operate with the display device to display the first visual indicator by displaying the symbols displayed at the one or more same symbol display areas associated with both the first payline and the second payline and forming the first designated symbol combination in a blinking manner.

4. The gaming system of claim 1, wherein (a) to (f) are part of a play of a bonus game.

5. The gaming system of claim 1, wherein the plurality of instructions, when executed by the processor, cause the processor to operate with the display device to, if the symbols displayed at the one or more same symbol display areas associated with both the first payline and the second payline form the first designated symbol combination, for each of the first payline and the second payline, display a second visual indicator in association with any symbol display areas associated with said payline that do not display a symbol forming the first designated symbol combination, the second visual indicator being different than the first visual indicator and in addition to any displayed indications of the first and second paylines.

6. The gaming system of claim 1, wherein the plurality of paylines include a third payline associated with a third plurality of the symbol display areas and a fourth payline associated with a fourth plurality of the symbol display areas, wherein the third plurality of the symbol display areas and the fourth plurality of the symbol display areas are different and are associated with one or more of the same symbol display areas, and the plurality of instructions, when executed by the processor, cause the processor to operate with the display device to, if the symbols displayed at the one or more same symbol display areas associated with both the third payline and the fourth payline form a second designated symbol combination, the second designated symbol combination being different than the first designated symbol combination, simultaneously indicate the second designated symbol combination formed along both the third and fourth paylines by displaying a third visual indicator in association with the one or more same symbol display areas shared by both the third payline and the fourth payline, the third visual indicator being in addition to any displayed indications of the third and fourth paylines.

7. The gaming system of claim 1, which includes an acceptor, and wherein the plurality of instructions, when executed by the processor, cause the processor to operate with the acceptor to:

if currency is physically received by the acceptor, establish a credit balance based at least in part on a monetary value associated with the received physical currency;

if an actuation of a wager button is received, place a wager, the credit balance being decreasable by the wager; and randomly generate and display the plurality of symbols at the plurality of symbol display areas after placing the wager, wherein the credit balance is increasable by any determined awards.

8. The gaming system of claim 5, wherein the plurality of instructions, when executed by the processor, cause the processor to operate with the display device to display the second visual indicator by displaying a line.

9. The gaming system of claim 8, wherein the plurality of instructions, when executed by the processor, cause the processor to operate with the display device to display the first visual indicator by displaying an outline surrounding the one or more same symbol display areas.

10. The gaming system of claim 6, wherein the plurality of instructions, when executed by the processor, cause the processor to operate with the display device to display the first visual indicator before displaying the third visual indicator.

11. The gaming system of claim 6, wherein the first visual indicator and the third visual indicator are different.

12. A method of operating a gaming system, said method comprising:

(a) causing a processor to operate with a display device to display a plurality of symbol display areas;

(b) causing the processor to operate with the display device to display a plurality of paylines, each payline being associated with a different plurality of the symbol display areas, the plurality of paylines including:

(i) a first payline associated with a first plurality of the symbol display areas, and (ii) a second payline associated with a second plurality of the symbol display areas, wherein the first plurality of the symbol display areas and the second plurality of the symbol display areas are different and are associated with one or more of the same symbol display areas;

(c) causing the processor to randomly generate and operate with the display device to display a plurality of symbols at the plurality of symbol display areas;

(d) for each payline:

(i) causing the processor to determine whether the symbols displayed at the symbol display areas associated with said payline form a first designated symbol combination; and (ii) if the symbols displayed at the symbol display areas associated with said payline form the first designated symbol combination, causing the processor to determine an award associated with the first designated symbol combination;

(e) if the symbols displayed at the one or more same symbol display areas associated with both the first payline and the second payline form the first designated symbol combination, causing the processor to operate with the display device to simultaneously indicate the first designated symbol combination formed along both the first and second paylines by displaying a first visual indicator in association with the one or more same symbol display areas shared by both the first payline and the second payline, the first visual indicator being in addition to any displayed indications of the first and second paylines; and (f) causing the processor to operate with the display device to display any determined awards.

13. The method of claim 12, wherein causing the processor to operate with the display device to display the first visual indicator includes causing the processor to operate with the display device to display an outline surrounding the one or more same symbol display areas.

14. The method of claim 12, wherein causing the processor to operate with the display device to display the first visual indicator includes causing the processor to operate with the display device to display the symbols displayed at the one or more same symbol display areas associated with both the first payline and the second payline and forming the first designated symbol combination in a blinking manner.

15. The method of claim 12, wherein (a) to (f) are part of a play of a bonus game.

16. The method of claim 12, which includes causing the processor to operate with the display device to, if the symbols displayed at the one or more same symbol display areas associated with both the first payline and the second payline form the first designated symbol combination, for each of the first payline and the second payline, display a second visual indicator in association with any symbol display areas associated with said payline that do not display a symbol forming the first designated symbol combination, the second visual indicator being different than the first visual indicator and in addition to any displayed indications of the first and second paylines.

17. The method of claim 12, wherein the plurality of paylines include a third payline associated with a third plurality of the symbol display areas and a fourth payline associated with a fourth plurality of the symbol display areas, wherein the third plurality of the symbol display areas and the fourth plurality of the symbol display areas are different and are associated with one or more of the same symbol display areas, and which includes causing the processor to operate with the display device to, if the symbols displayed at the one or more same symbol display areas associated with both the third payline and the fourth payline form a second designated symbol combination, the second designated symbol combination being different than the first designated symbol combination, simultaneously indicate the second designated symbol combination formed along both the third and fourth paylines by displaying a third visual indicator in association with the one or more same symbol display areas shared by both the third payline and the fourth payline, the third visual indicator being in addition to any displayed indications of the third and fourth paylines.

18. The method of claim 12, which includes:

if currency is physically received by an acceptor, causing the processor to establish a credit balance based at least in part on a monetary value associated with the received physical currency;

if an actuation of a wager button is received, causing the processor to place a wager, the credit balance being decreasable by the wager; and causing the processor to randomly generate and operate with the display device to display the plurality of symbols at the plurality of symbol display areas after placing the wager, wherein the credit balance is increasable by any determined awards.

19. The method of claim 16, wherein causing the processor to operate with the display device to display the second visual indicator includes causing the processor to operate with the display device to display a line.

20. The method of claim 19, wherein causing the processor to operate with the display device to display the first visual indicator includes causing the processor to operate with the display device to display an outline surrounding the one or more same symbol display areas.

21. The method of claim 17, which includes causing the processor to operate with the display device to display the first visual indicator before displaying the third visual indicator.

22. The method of claim 17, wherein the first visual indicator and the third visual indicator are different.

* * * * *